United States Patent [19]

Klett et al.

[11] 4,077,142

[45] Mar. 7, 1978

[54] ADJUSTABLE CUTTING EDGE ASSEMBLY FOR A POWER EARTH MOVER

[75] Inventors: Gene R. Klett; Warner G. Richardson, both of Joliet, Ill.

[73] Assignee: Caterpillar Tractor Co., Peoria, Ill.

[21] Appl. No.: 780,554

[22] Filed: Mar. 23, 1977

[51] Int. Cl.[2] ..... E02F 9/28

[52] U.S. Cl. ..... 37/141 R; 172/719; 151/19 A

[58] Field of Search ..... 37/141 T, 141 R, 142 R; 172/719, 737; 151/19 R, 19 A

[56] References Cited

U.S. PATENT DOCUMENTS

| | | | |
|---|---|---|---|
| 2,189,745 | 2/1940 | Johnson | 37/141 R X |
| 2,285,039 | 6/1942 | Lowe | 37/141 R |
| 2,310,396 | 2/1943 | Clinkscales, Jr. | 172/737 |
| 2,866,280 | 12/1958 | O'Connor | 37/141 R X |
| 3,059,357 | 10/1962 | Irish | 37/141 R |
| 3,511,289 | 5/1970 | Coyle | 151/19 A |
| 3,845,578 | 11/1974 | Holmstrom | 37/141 R |
| 3,942,271 | 3/1976 | George | 37/141 R X |
| 3,984,929 | 10/1976 | Meyer et al. | 37/141 R |

*Primary Examiner*—E. H. Eickholt

*Attorney, Agent, or Firm*—Wegner, Stellman, McCord, Wiles & Wood

[57] ABSTRACT

The scraper bowls of power earth movers have a support bar across the front on which a replaceable cutting blade is mounted. In the apparatus of the present invention the cutting blade is mounted for angular adjustment relative to the front of the bowl, so that the cutting edge of the blade may be disposed to form a precisely horizontal surface. This permits such a power earth mover to be used for final grading and cleanup work which often requires a completely horizontal cut on the grade. The present invention compensates for manufacturing tolerances which often cause the bowl to be supported at a slight angle to the horizontal.

12 Claims, 7 Drawing Figures

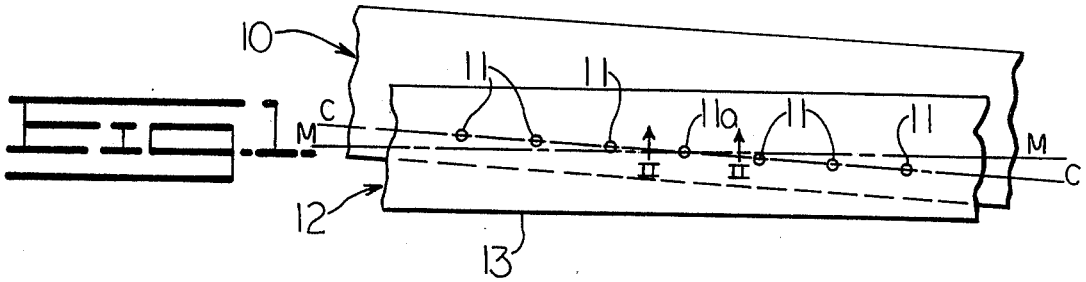
Fig. 1
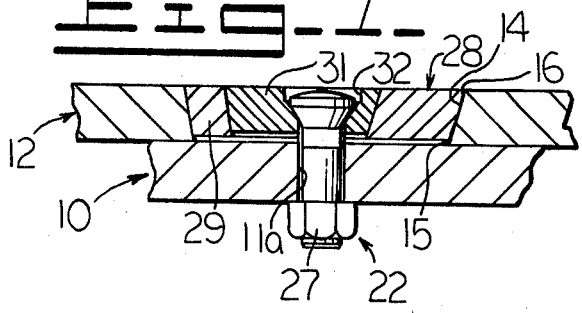
Fig. 7
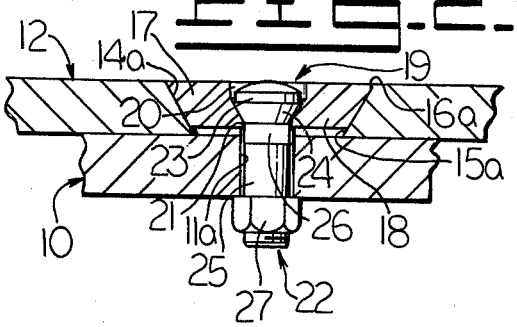
Fig. 2
Fig. 3
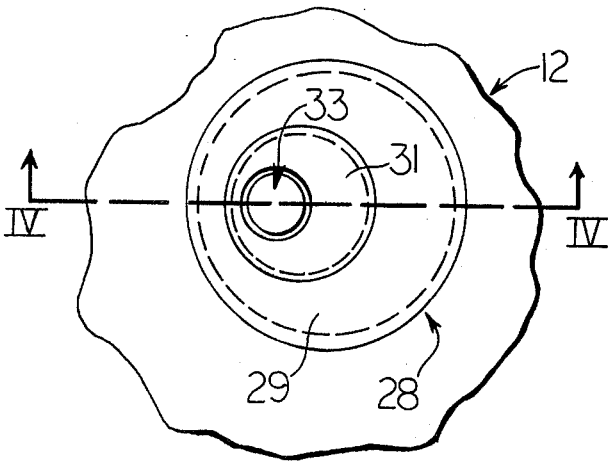
Fig. 4
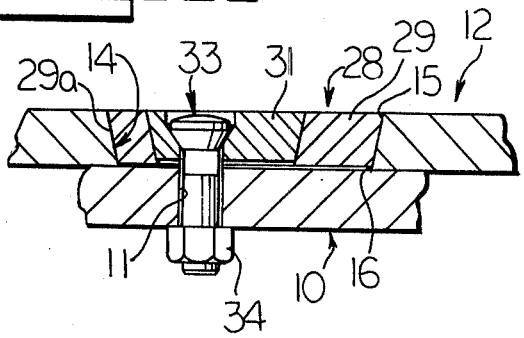
Fig. 5
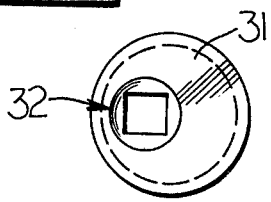
Fig. 6
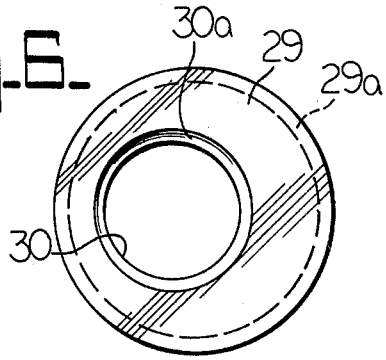

ADJUSTABLE CUTTING EDGE ASSEMBLY FOR A POWER EARTH MOVER

BACKGROUND OF THE INVENTION

There are quite a number of situations in which a graded surface must be precisely horizontal. A motor grader blade has a variety of adjustments which permit it to be oriented with the cutting edge of its blade precisely horizontal; but power earth movers such as elevating scrapers have no such capability. Nevertheless, there are numerous circumstances under which final grading could be handled with a power earth mover provided it could be assured that the cutting edge of the earth mover bowl is exactly horizontal.

The mechanics and geometry of earth mover bowl mounting are such that normal manufacturing tolerances make it very unlikely that the cutting edge of a bowl will be horizontal. The bowl is carried upon arms which are pivoted at opposite sides of the vehicle. Manufacturing problems make it impossible to get the arm pivot centers precisely coaxial while also getting the arms identically mounted on the pivots and the two sides of the scraper bowl identically mounted upon the arms. These have created insurmountable problems for making a power earth mover which can be used to make horizontal finishing cuts on a grading operation.

SUMMARY OF THE INVENTION

The present invention is directed to overcoming one or more of the problems as set forth above.

According to the present invention, the bowl of a power earth mover is provided with an adjustable cutting edge assembly which makes it relatively easy to orient the cutting blade so that its cutting edge is precisely horizontal.

This is accomplished by pivoting the cutting blade on the conventional support bar which is at the front of the earth mover bowl, and providing a plurality of eccentric means operatively associated with the blade and with the mounting bolts of the blade so that the blade may be firmly secured at an angle with respect to the front of the bowl.

THE DRAWINGS

FIG. 1 is a diagrammatic view illustrating the relationship between the center line of the bolt holes on the cutting blade support bar of a scraper bowl and the center line of a cutting blade which is adjusted to a horizontal orientation;

FIG. 2 is a fragmentary enlarged sectional view taken substantially as indicated along the line II—II of FIG. 1, showing one type of pivot mounting at the center of the blade;

FIG. 3 is a fragmentary plan view of the eccentric means employed with each of the mounting bolts other than the bolt illustrated in FIG. 2;

FIG. 4 is a sectional view taken substantially as indicated along the line IV—IV of FIG. 3;

FIG. 5 is a plan view of one of the two components of the eccentric means;

FIG. 6 is a plan view of the other of the two components of the eccentric means; and FIG. 7 illustrates the eccentric means of FIG. 4 adjusted so the bolt may serve as a pivot bolt.

DETAILED DESCRIPTION OF THE INVENTION

The present invention constitutes an improvement upon power earth movers having a scraper bowl, and U.S. Pat. No. 3,857,190 illustrates one type of power earth mover to which the invention is applicable. Commonly, an apparatus such as disclosed in U.S. Pat. No. 3,857,190 has a separate support bar along the forward margin of the bowl floor, and the scraper blade which provides the cutting edge is mounted upon the support bar rather than being connected directly to the bottom of the bowl.

In the drawings of the present application, 10 indicates a support bar which may be secured to the forward margin of a scraper bowl and which has a plurality of spaced bolt holes 11 at predetermined intervals along its length. While no more than two or three bolt holes are required for the present invention, in practice a substantial number of bolt holes are used to withstand the heavy loads to which the blade providing the cutting edge is subjected in operation. In the drawings, the blade is indicated as 12, and as seen in FIG. 1 a line *c—c* through the centers of the bolt holes 11 is parallel to the front and rear margins of the support bar 10, but is not parallel to the forward cutting edge 13 of the blade 12. Thus, the longitudinal median line *m—m* of the blade crosses the line *c—c* at one of the bolt holes 11, which in the present case is the center bolt hole indicated by the reference numeral 11*a*.

The blade 12 is provided with a plurality of round mounting holes 14 each of which is associated and in register with one of the bolt holes 11; and a centrally positioned mounting hole 14*a* registers with the central bolt hole 11*a* of the support bar 10. Each of the mounting holes 14 and 14*a* tapers from top to bottom, so that it has a lower margin 15 which is smaller in diameter than its upper margin 16; and this is true also of the central mounting hole 14*a* which has a lower margin 15*a* that is smaller in diameter than its upper margin 16*a*.

A pivot disc 17 which is complementary to the mounting hole 14*a* is rotatably mounted in said mounting hole and is thinner than the blade 12 so that its lower surface 18 is spaced from the top of the support bar 10. The pivot disc 17 has a bore, indicated generally at 19, which may be located anywhere in the disc 17 but which preferably has its axis on the center of the disc. The upper portion of the bore 19 consists of a tapered counterbore 20, and the lowermost portion 21 of the bore 19 is square. The disc 17 constitutes first disc means.

Mounted in the bore 19 and extending through the central bolt hole 11*a* of the support bar 10 is a pivot bolt, indicated generally at 22, which has a head 23 with a tapered base 24, and a shank 25 which has a square upper end portion 26. Thus, the bolt head 23 is countersunk below the top of the blade 12 in use, and the bolt is nonrotatable in the pivot disc 17. A nut 27 screws onto a threaded extremity of the shank 25 to secure the blade 12 to the support bar 10 after it is properly adjusted.

In each of the mounting holes 14 there is second disc means, indicated generally at 28, which is seen to include a round support disc 29 which has an eccentrically positioned opening 30; and a round bolt carrier disc 31 which is seated in the eccentrically positioned opening 30 and has an eccentrically positioned bore, indicated generally at 32, that extends through it from top to bottom. The support disc 29 has a tapered periphery 29*a* which is complementary to the tapered wall of the mounting hole 14; and the bolt carrier disc 31 has a tapered circumferential surface 31*a* which is complementary to the wall 30*a* of the eccentrically positioned opening 30. Thus, the support disc 29 is rotatable in the mounting hole 14, and the bolt carrier disc 31 is rotatable in the support disc 29. By proper adjustment of the disc 29 and 31 the eccentrically positioned bore 32 in the carrier disc 31 may be axially aligned with an associated bolt hole 11 in the support bar 10. This permits an orienting bolt, indicated generally at 33, to be mounted in each of the eccentric bores 32 impaling a bolt hole 11 in order that it may receive a nut 34. The eccentrically positioned bore 32 and the orienting bolt 33 are identical, respectively, with the bore 19 in the pivot disc and with the pivot bolt 22, so are not further described.

In use, the blade 12 is pivoted about the pivot disc 17 until its cutting edge 13 is horizontal. One second disc means consisting of a support disc 29 and a bolt carrier disc 31 is mounted in an endmost mounting hole 14 and adjusted to bring the eccentric hole 32 in the bolt carrier disc into axial alignment with the associated bolt hole 11. An orienting bolt 33 is then seated in the eccentrically positioned bore 32 and secured in place by a nut 34. This is sufficient to fix the blade 12 at the correct angle with reference to the support bar 10, and the remaining second disc means and orienting bolts are then placed in the remaining mounting holes 14 and the bolts are tightened with nuts 34.

Although the bolt hole 11*a* in which the pivot bolt is mounted is shown and described as being the center bolt hole, so that it is midway between the ends of the support bar 10, it is perfectly apparent that the pivot bolt could be located in any bolt hole. Placing it in the center bolt hole merely minimizes the amount of eccentricity required in the eccentric means 28 in order to properly fix the positions of the orienting bolts 33 at the two ends of the blade and the support bar.

FIG. 7 shows how the second disc means 28 can be adjusted so that the bolt in it can serve as a pivot bolt by having its axis at the center of a mounting hole 14. This arrangement eliminates the need for a pivot disc which is different from the discs 29 and 31. The foregoing detailed description is given for clearness of understanding only and no unnecessary limitations should be understood therefrom as modifications will be obvious to those skilled in the art.

The embodiments of the invention in which an exclusive property or privilege is claimed are defined as follows:

1. An adjustable cutting edge assembly for the scraper bowl of a power earth mover which has a transverse support bar at its forward margin provided with a plurality of bolt holes at predetermined intervals along its length, said assembly comprising, in combination:

a blade with a forward cutting edge which extends substantially from end to end of said support bar, said cutting blade having a plurality of round mounting holes each of which is associated and in register with one of said bolt holes, said mounting holes being substantially larger in diameter than are the bolt holes;

first disc means rotatably mounted in one of said mounting holes, said first disc means having a bore the axis of which is concentric in the mounting hole and in register with the associated bolt hole;

a pivot hole in said bore and said associated bolt hole providing an axis for pivoting the cutting blade on the support bar;

second disc means rotatably mounted in another of said mounting holes, said second disc means having a bore the axis of which is eccentric in the mounting hole and in register with the associated bolt hole;

and an orienting bolt extending through the eccentrically positioned bore and the associated bolt hole, whereby the blade may be firmly secured to the support bar with its cutting edge at a small angle to a line through the centers of the bolt holes.

2. The combination of claim 1 in which there is a center bolt hole equidistant from the ends of the mounting bar, and the first disc means is in the mounting hole which is associated with said center bolt hole.

3. The combination of claim 1 in which the first disc means is a single pivot disc, and the bore in said pivot disc is at the center of the disc.

4. The combination of claim 3 in which the bore in the single disc has a square bore portion and the pivot bolt has a square portion non-rotatably engaged in said square bore portion.

5. The combination of claim 1 in which there are several bolt holes and associated mounting holes, and there is a second disc means and an orienting bolt in each mounting hole except for said one of said mounting holes.

6. The combination of claim 1 in which the second disc means includes a support disc which is rotatably seated in the mounting hole and has a round eccentrically positioned opening, and a bolt carrier disc which is rotatably seated in said opening, each said carrier disc having an eccentrically positioned bore aligned with the associated bolt hole.

7. The combination of claim 6 in which the mounting holes and the openings in the support discs are smaller at the bottom than at the top, the periphery of the support discs and of the pivot disc are complementary to the mounting holes and the periphery of the carrier discs are complementary to the openings.

8. The combination of claim 7 in which the mounting holes and the openings are uniformly tapered from top to bottom.

9. The combination of claim 6 in which each eccentrically positioned bore has a square bore portion and each orienting bolt has a square portion non-rotatably engaged in said square bore portion.

10. The combination of claim 6 in which the first disc means is a single pivot disc and the bore in said pivot disc is at the center of the disc and has a square bore portion, and the pivot bolt has a square portion non-rotatably engaged in said square bore portion.

11. The combination of claim 10 in which the bore in the single pivot disc and the bore in the bolt carrier disc all have tapered counter bores in their upper portion, the bolts have heads complementary to said counterbores and fuly recessed therein, the square portions of the bore and of the holes in the carrier discs are below said counterbores, and the bolts have square shank portions.

12. The combination of claim 6 in which the first disc means includes a first support disc which is rotatably seated in the mounting hole and has a round eccentrically positioned opening, and a first bolt carrier disc which is rotatably seated in said opening, said bolt carrier disc having an eccentrically positioned bore which is concentric in the mounting hole.

* * * * *